US010841687B2

(12) United States Patent
Ott et al.

(10) Patent No.: US 10,841,687 B2
(45) **Date of Patent: *Nov. 17, 2020**

(54) HEADPHONE APPARATUS

(71) Applicant: Harman International Industries, Incorporated, Stamford, CT (US)

(72) Inventors: Ryan Ott, Stamford, CT (US); Daniel I. Radin, Stamford, CT (US); Effrosini A. Karayiannis, St. Louis, MO (US); Kent Jopling, Tulsa, OK (US); Torry Xu, Shenzhen (CN)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/521,291

(22) Filed: Jul. 24, 2019

(65) Prior Publication Data

US 2019/0349659 A1 Nov. 14, 2019

Related U.S. Application Data

(63) Continuation of application No. 15/688,236, filed on Aug. 28, 2017, now Pat. No. 10,419,839.

(51) Int. Cl.
*H04R 1/10* (2006.01)
*H04R 5/033* (2006.01)

(52) U.S. Cl.
CPC ..... *H04R 1/105* (2013.01); *H04R 1/1016* (2013.01); *H04R 1/1066* (2013.01); *H04R 5/0335* (2013.01); *H04R 2201/10* (2013.01)

(58) Field of Classification Search
CPC .... H04R 1/105; H04R 1/1058; H04R 1/1066; H04R 5/0335
See application file for complete search history.

(56) References Cited

U.S. PATENT DOCUMENTS

| | | | |
|---|---|---|---|
| 5,953,435 | A | 9/1999 | Mullin et al. |
| 8,254,621 | B2 | 8/2012 | Silvestri et al. |
| 8,311,253 | B2 | 11/2012 | Silvestri et al. |
| 8,737,669 | B2 | 5/2014 | Monahan et al. |

(Continued)

FOREIGN PATENT DOCUMENTS

| | | | |
|---|---|---|---|
| CN | 101562764 | A | 10/2009 |
| EP | 3128761 | A1 | 2/2017 |

OTHER PUBLICATIONS

A screen capture from YouTube video clip entitled "groov-eIAction GVBT800 Wireless Sports Earphones with LED Neckband" (uploaded on Jul. 20, 2017 by groov-e. Retrieved from Internet: <https://www.youtube.com/watch?v=2h3lTbu7430> (Year: 2017).*

(Continued)

*Primary Examiner* — Fan S Tsang
*Assistant Examiner* — Angelica M Mckinney
(74) *Attorney, Agent, or Firm* — Brooks Kushman P.C.

(57) ABSTRACT

A headphone apparatus includes a neckband having a first arm and a second arm joined by a central portion therebetween. The first and second arms each have a flexible section proximal to the central portion, the flexible sections including a memory material for dynamically creating and maintaining a desired shape of the neckband. The headphone apparatus further includes first and second earbuds connected to the neckband.

8 Claims, 8 Drawing Sheets

(56) References Cited

U.S. PATENT DOCUMENTS

| | | | | |
|---|---|---|---|---|
| 8,761,424 | B2 | 6/2014 | Wubker et al. | |
| 8,897,480 | B2 | 11/2014 | Tan et al. | |
| 8,929,582 | B2 | 1/2015 | Silvestri et al. | |
| 8,989,426 | B2 | 3/2015 | Silvestri et al. | |
| 9,036,852 | B2 | 5/2015 | Silvestri et al. | |
| 9,036,853 | B2 | 5/2015 | Silvestri et al. | |
| 9,042,590 | B2 | 5/2015 | Silvestri et al. | |
| 9,398,364 | B2 | 7/2016 | Monahan et al. | |
| 9,723,395 | B2 | 8/2017 | Kim | |
| D835,077 | S * | 12/2018 | Aoyagi | D14/223 |
| D881,163 | S * | 4/2020 | Duddy | D14/223 |
| 2009/0147981 | A1 | 6/2009 | Blanchard et al. | |
| 2009/0274335 | A1 | 11/2009 | Cheung et al. | |
| 2010/0041447 | A1* | 2/2010 | Graylin | G10L 15/26 455/575.2 |
| 2012/0039501 | A1 | 2/2012 | Silvestri et al. | |
| 2013/0058517 | A1 | 3/2013 | Lee et al. | |
| 2013/0256345 | A1* | 10/2013 | Larkin | H04R 1/105 224/201 |
| 2014/0119589 | A1* | 5/2014 | Wyzisk | H04R 1/105 381/380 |
| 2015/0030194 | A1 | 1/2015 | Burgett et al. | |
| 2015/0139474 | A1 | 5/2015 | Henry et al. | |
| 2015/0156579 | A1* | 6/2015 | Lowry | H04R 1/1016 381/380 |
| 2015/0351688 | A1 | 12/2015 | Just et al. | |
| 2016/0066079 | A1* | 3/2016 | Kolton | H04R 1/1058 381/380 |
| 2016/0073192 | A1 | 3/2016 | Briggs et al. | |
| 2016/0269817 | A1* | 9/2016 | Basseas | H04R 1/1083 |
| 2016/0366506 | A1* | 12/2016 | Kim | H04R 1/1091 |
| 2016/0381453 | A1 | 12/2016 | Ushakov | |
| 2017/0070801 | A1 | 3/2017 | Nguyen et al. | |
| 2017/0339481 | A1 | 11/2017 | Laberge | |
| 2018/0220725 | A1* | 8/2018 | Graylin | A41D 1/002 |
| 2018/0242068 | A1* | 8/2018 | Kelley | H04R 1/105 |
| 2019/0069064 | A1 | 2/2019 | Ott et al. | |

OTHER PUBLICATIONS

A screen capture from YouTube video clip entitled "groov-e Action GVBT800 Wireless Sports Earphones with LED Neckband", uploaded on Jul. 20, 2017 by groov-e, https://www.youtube.com/watch?v=2h3lTbu7430.

* cited by examiner

HEADPHONE APPARATUS

CROSS-REFERENCE TO RELATED APPLICATIONS

This application is a continuation of U.S. application Ser. No. 15/688,236 filed Aug. 28, 2017, the disclosure of which is hereby incorporated in its entirety by reference herein.

TECHNICAL FIELD

Embodiments relate to a headphone apparatus having a neckband configuration, and an earbud which may be used with the headphone apparatus.

BACKGROUND

Consumers use headphones for enjoying music, audio books, podcasts, or other types of media in a variety of different situations throughout the day. During routine daily wear, headphone qualities such as comfort and flexibility may be desired. However, for sports activity, users require a stable and secure fit that can withstand more vigorous movement. Neckband or collar-style headphones are often selected by consumers to function for these various uses, where these types of headphones include an around-the-neck band structure with left and right side earphones attached to the band. Existing neckband headphones may feature a fixed-curvature, one-size-fits-all band design sized to fit loosely around the neck to provide all-day comfort, but which does not fit securely enough for sports. Other existing neckband headphones may be designed with a fixed-curvature band having a tighter radius for an athletic fit that provides stability during sports, but that is uncomfortable for long wearing periods.

SUMMARY

In one embodiment, a headphone apparatus includes a neckband having a first arm and a second arm joined by a central portion therebetween. The first and second arms each have a flexible section proximal to the central portion, the flexible sections including a memory material for dynamically creating and maintaining a desired shape of the neckband. The headphone apparatus further includes first and second earbuds connected to the neckband.

In another embodiment, a wireless headphone apparatus includes a generally U-shaped neckband having a first arm and a second arm connected by a central portion. The first and second arms each have a flexible section proximal to the central portion and a rigid section distal from the central portion. Each flexible section includes a wire material capable of bending and maintaining a desired shape of the neckband. The wireless headphone apparatus further includes first and second earbuds connected to the neckband via cables, the earbuds each including a housing having a speaker disposed therein and a flexible ear tip removably connected to the housing.

In another embodiment, an earbud includes a housing having a speaker disposed therein, at least a portion of the housing sized to be received in a user's concha. The earbud includes a flexible ear tip removably connected to the housing, the ear tip sized to be at least partially received in the user's ear canal. The ear tip has a bottom end proximal to the housing, a top end distal from the housing, and a middle portion therebetween, where the bottom end has a radius smaller than a radius of the middle portion. The earbud further includes an arcuate extension member extending from the housing and sized to be received in the user's antihelix, the extension member including a longitudinal slot.

DETAILED DESCRIPTION

Figure 1:
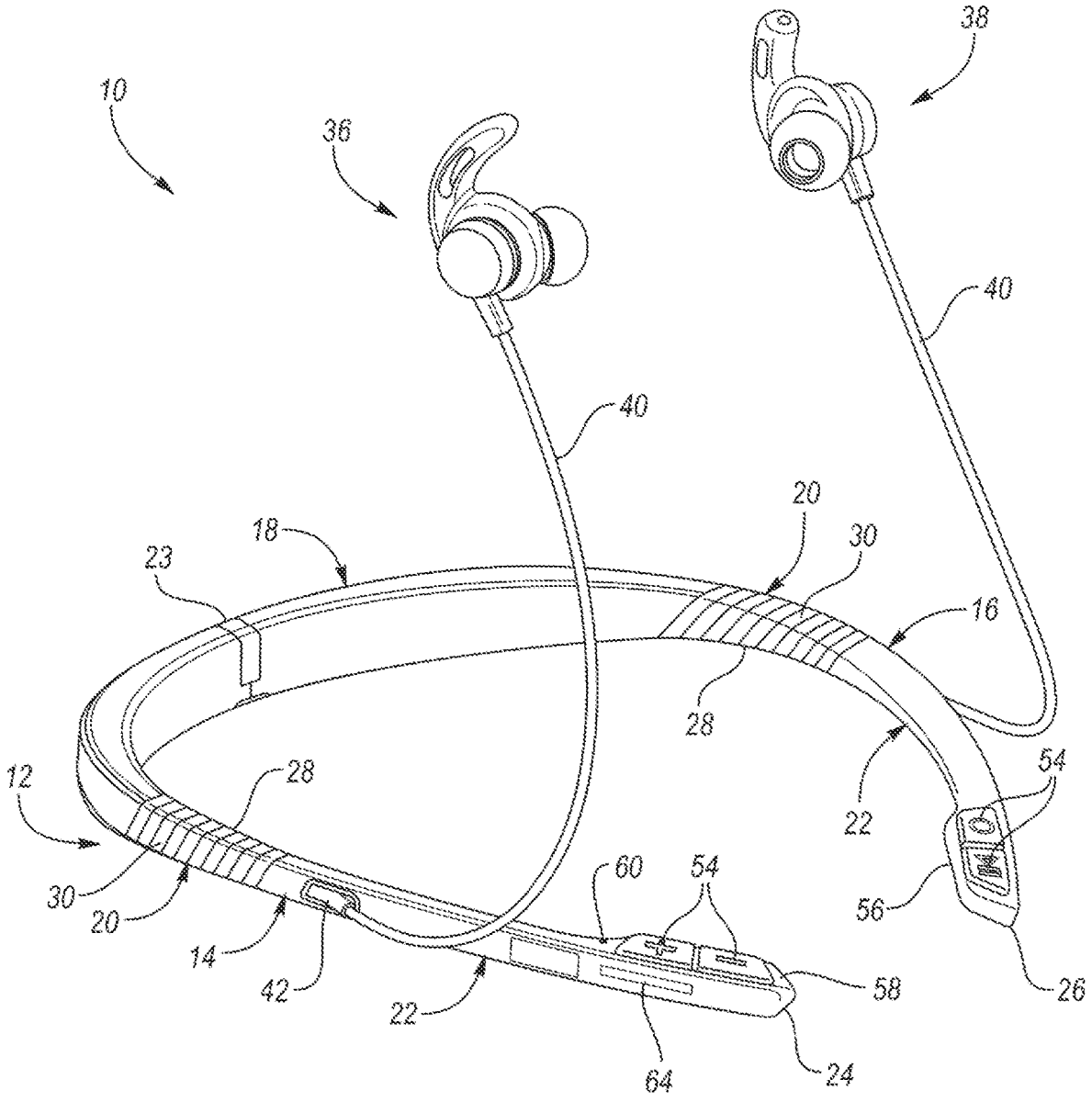
FIG. 1 is a perspective view of a headphone apparatus according to an embodiment.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

A headphone apparatus is provided herein which incorporates a flexible component into a rigid neckband structure, where the flexible component has memory capability such that the neckband shape may be selectively and dynamically customized by a user. This combination of rigidity and flexibility in the neckband provides an adjustable fit that enables the headphone apparatus to accommodate a wide range of neck sizes, and provides the ability for a user to wear the neckband with a looser fit (e.g., for all-day lifestyle wearing) or a tighter fit (e.g., for more secure athletic wearing) and adjust as needed, continuously.

With reference first to FIGS. 1-4, the headphone apparatus 10 includes a neckband 12 having a first arm 14 and a second arm 16 connected by a central portion 18. In one embodiment, the neckband 12 is generally U-shaped, where a portion thereof may be positioned at the back of a user's neck. The first and second arms 14, 16 each have a flexible section 20 proximal to the central portion 18 and a rigid section 22 distal from the central portion 18. In one embodiment, the flexible sections 20 may comprise between about 20% to 30% of a length of the neckband 12 from a middle point 23 of the central portion 18 to ends 24, 26 of the first and second arms 14, 16. Both the central portion 18 and the rigid sections 22 of the arms 14, 16 may be constructed from a plastic material. Each flexible section 20 may include a cover 28, constructed from a flexible material such as silicone rubber, wherein the cover 28 may have grooves 30 therein to facilitate movement of the flexible section 20 to the desired shape.

Figure 6:
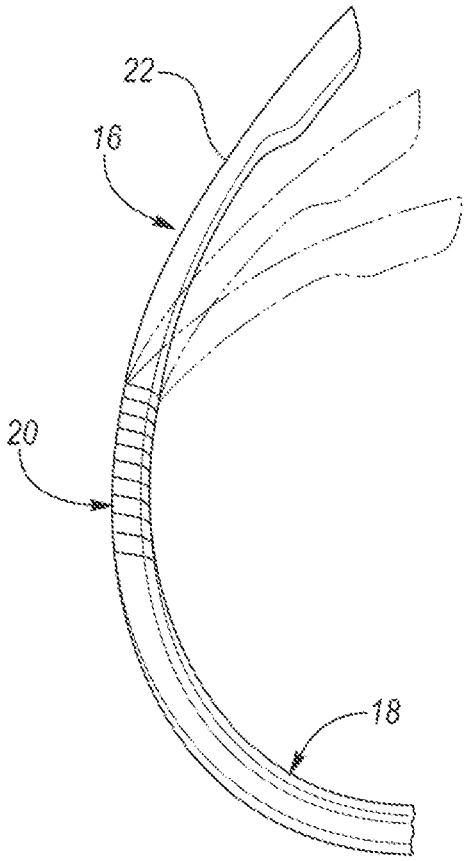
FIG. 6 is an illustration of possible positions of a neckband arm after bending the flexible section.
Figure 7:
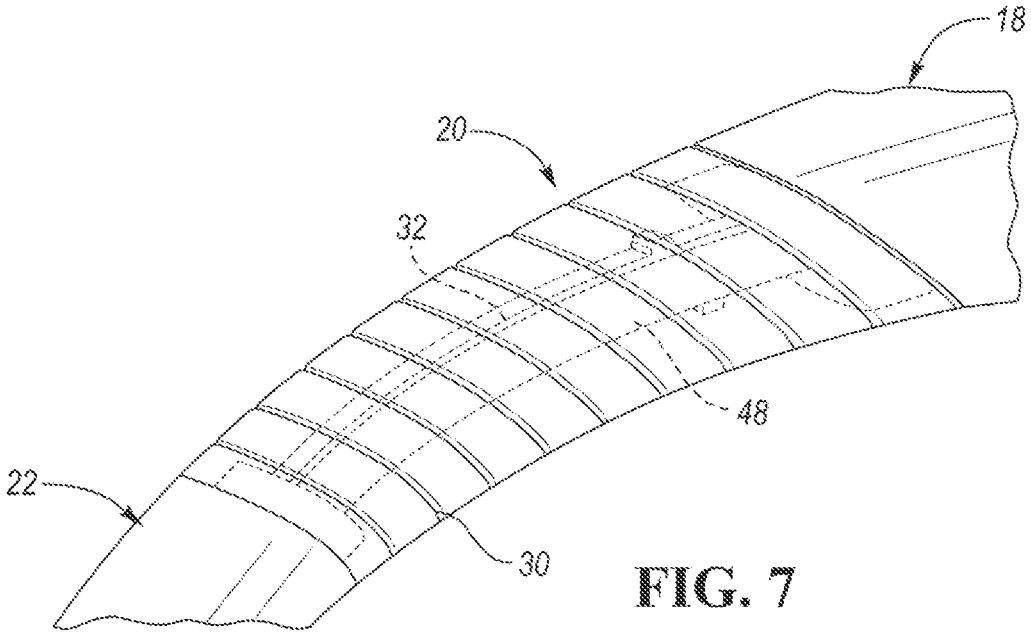
FIG. 7 is a transparent view through the flexible section of a neckband arm showing the memory material and electrical conductors.
Figure 8:
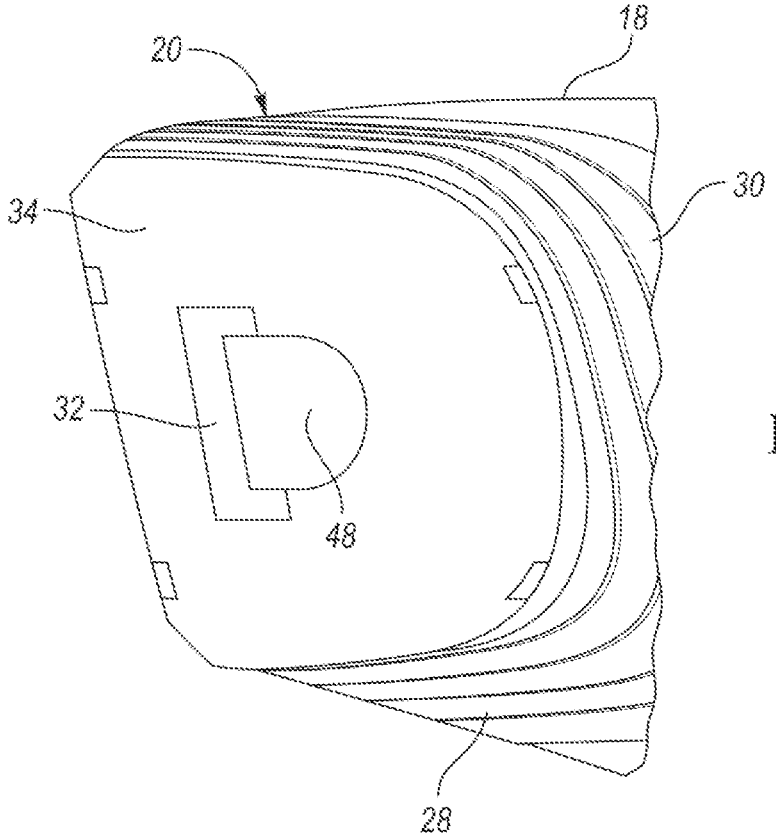
FIG. 8 is a cross-sectional view of the flexible section.
Figure 9:
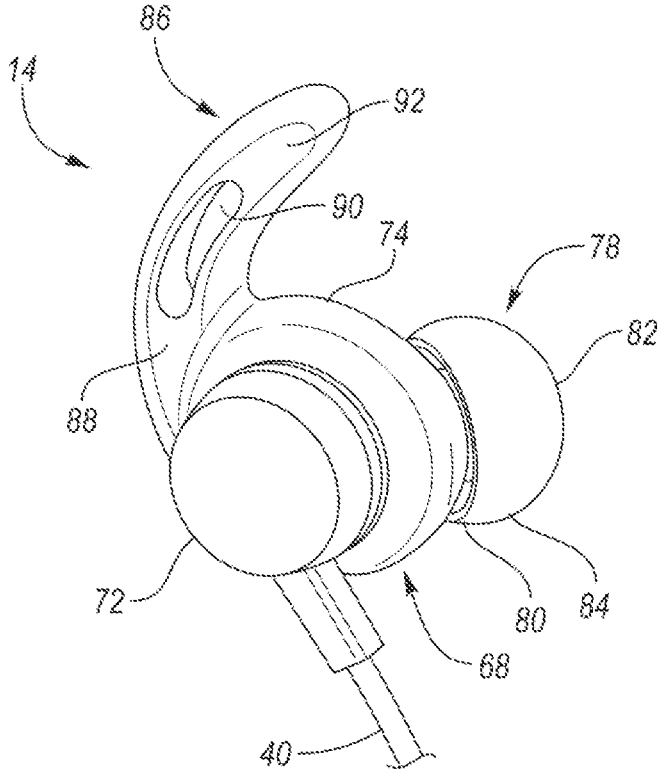
FIG. 9 is a front perspective view of an earbud of the headphone apparatus according to an embodiment.
Figure 10:
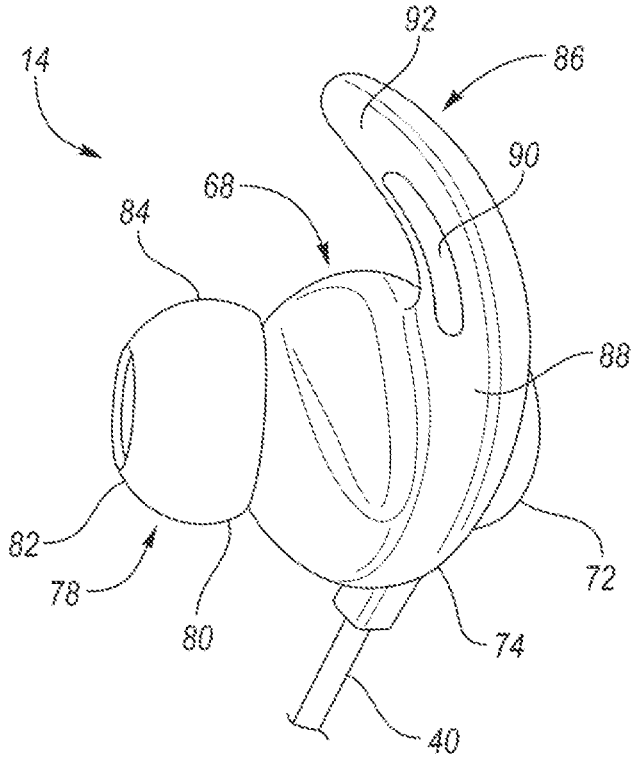
FIG. 10 is a rear perspective view of the earbud.
Figure 11:
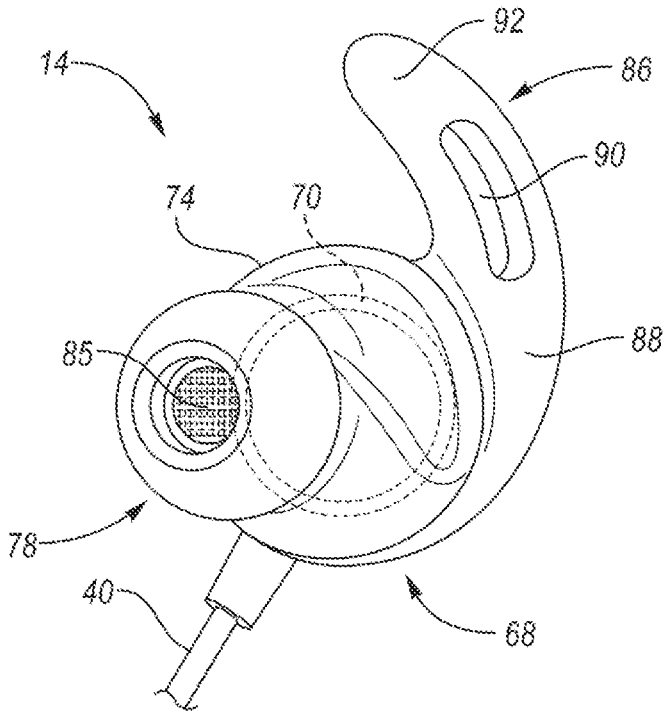
FIG. 11 is an end view of the earbud.
Figure 12:
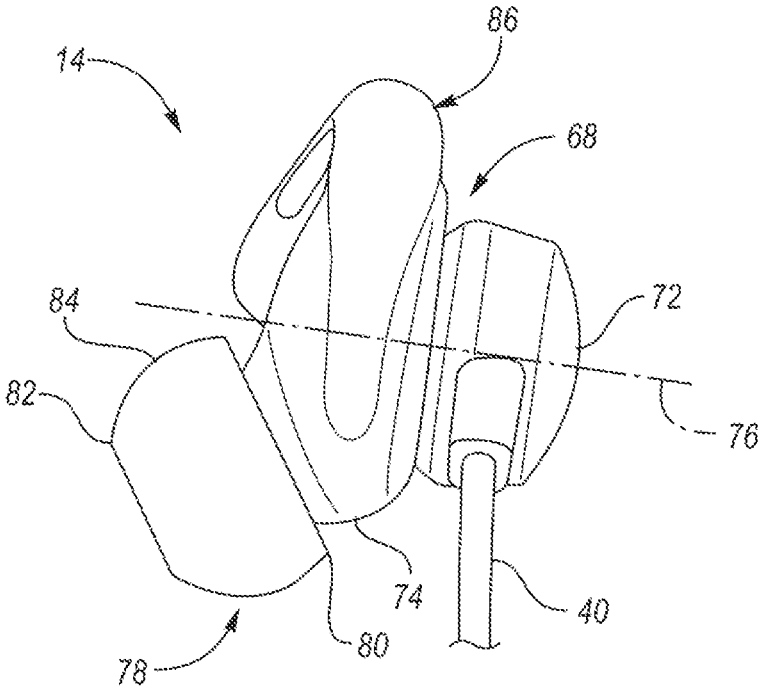
FIG. 12 is a side view of the earbud.

As best shown in FIGS. 6-8, the flexible sections 20 include a memory material 32 for creating and maintaining a desired shape of the neckband 12. The memory material 32 is a "bend-and-stay" material which extends lengthwise through the flexible section 20 from the central portion 18 to the rigid portion 22. In one embodiment, the memory material includes a wire material 32 capable of bending, such as stainless steel wire (e.g., stainless steel 304) or another soft-annealed metal. The memory wire 32 may have a generally rectangular cross-section such that the wire is more flexible for movement in a plane of the neckband 12 and less flexible for movement in a plane perpendicular to the plane of the neckband 12. In a non-limiting example, the wire 32 may have dimensions of 1 mm×3 mm. The memory material 32 may be encased in a rubber sheath 34, which is then enclosed by the cover 28.

Returning to FIGS. 1-4, the headphone apparatus 10 further includes first and second earbuds 36, 38 connected to the neckband 12, and specifically may be connected to the rigid sections 22 of the first and second arms 14, 16. The earbuds 36, 38 may be connected to the neckband 12 via cables 40 as shown, such that the earbuds 36, 38 can easily be positioned with respect to a user's ears. In an alternative embodiment, the earbuds 36, 38 could be connected to the neckband 12 by rigid members. An attachment joint 42 of the cables 40 or another connection member of the earbuds 36, 38 to the neckband 12 may also be movable or rotatable to aid in positioning the earbuds 36, 38.

Figure 4:
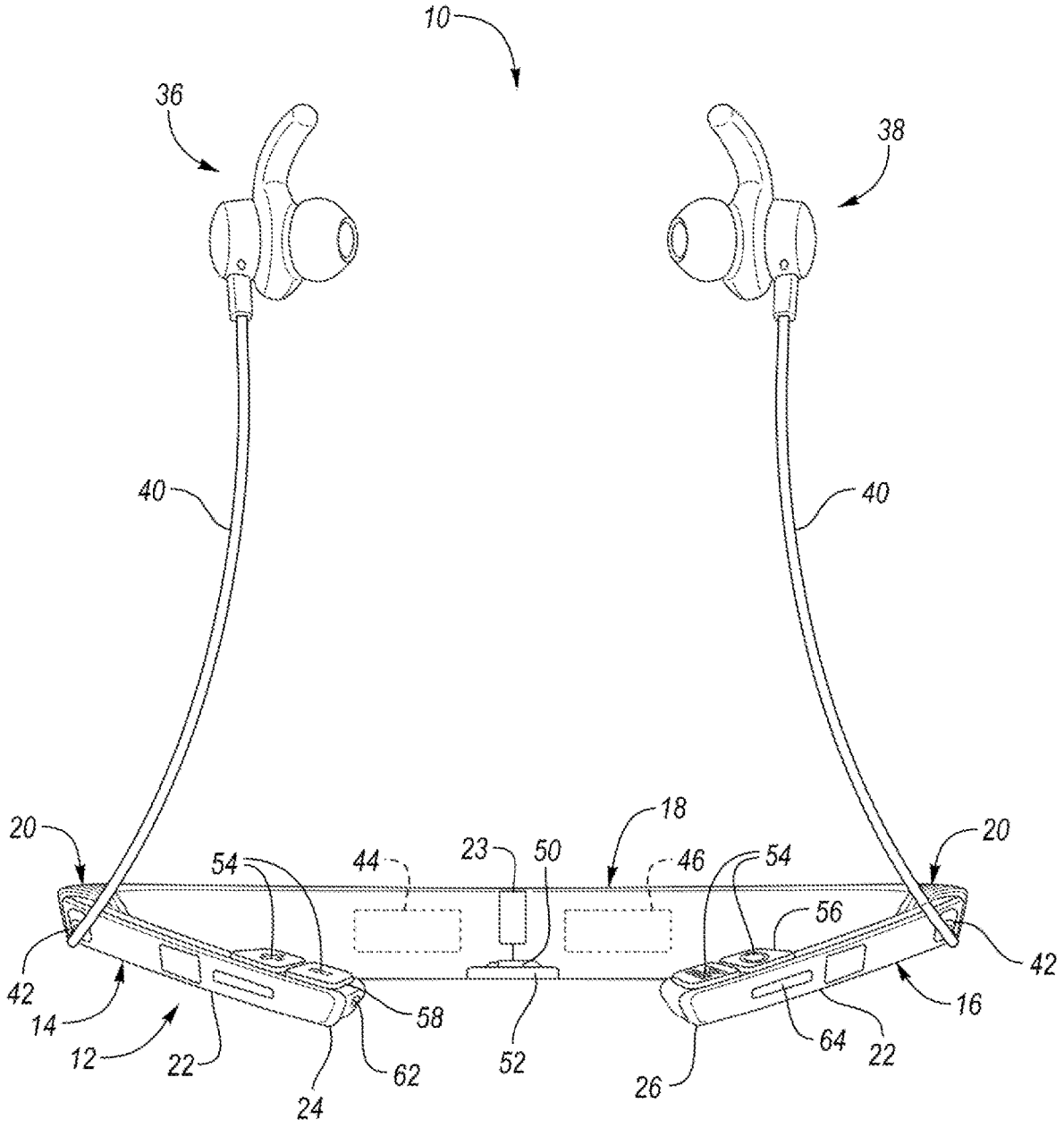
FIG. 4 is a front view of the headphone apparatus.

In the embodiment depicted, a cross-sectional area of the central portion 18 is larger than a cross-sectional area of the first and second arms 14, 16, where the central portion 18 houses control electronics 44 and a power source 46 (FIG. 4). Control electronics 44 may include, for example, a microprocessor, memory, a D/A converter and amplifiers for audio signal processing and other functions. In addition, the headphone apparatus 10 may include wireless capabilities, such that the control electronics 44 includes a wireless transceiver for receiving a wireless signal such as a Bluetooth signal, Wi-Fi, RF or infrared. Electrical conductors 48 run from the control electronics 44 in the central portion 18, through the first and second arms 14, 16 (see FIGS. 7-8), and through the cables 40 or other connection members to the earbuds 14, 16. The power source 46 is in electrical communication with the control electronics 44 and may include a rechargeable battery for supplying power to the various operating parts of the headphone apparatus 10. As shown in FIG. 4, the central portion 18 may include a port 50 for receiving a charging cable (not shown), such as a USB cable, to charge the power source 46. The port 50 may be concealed by a cover 52, such as constructed from a rubber material.

Figure 2:
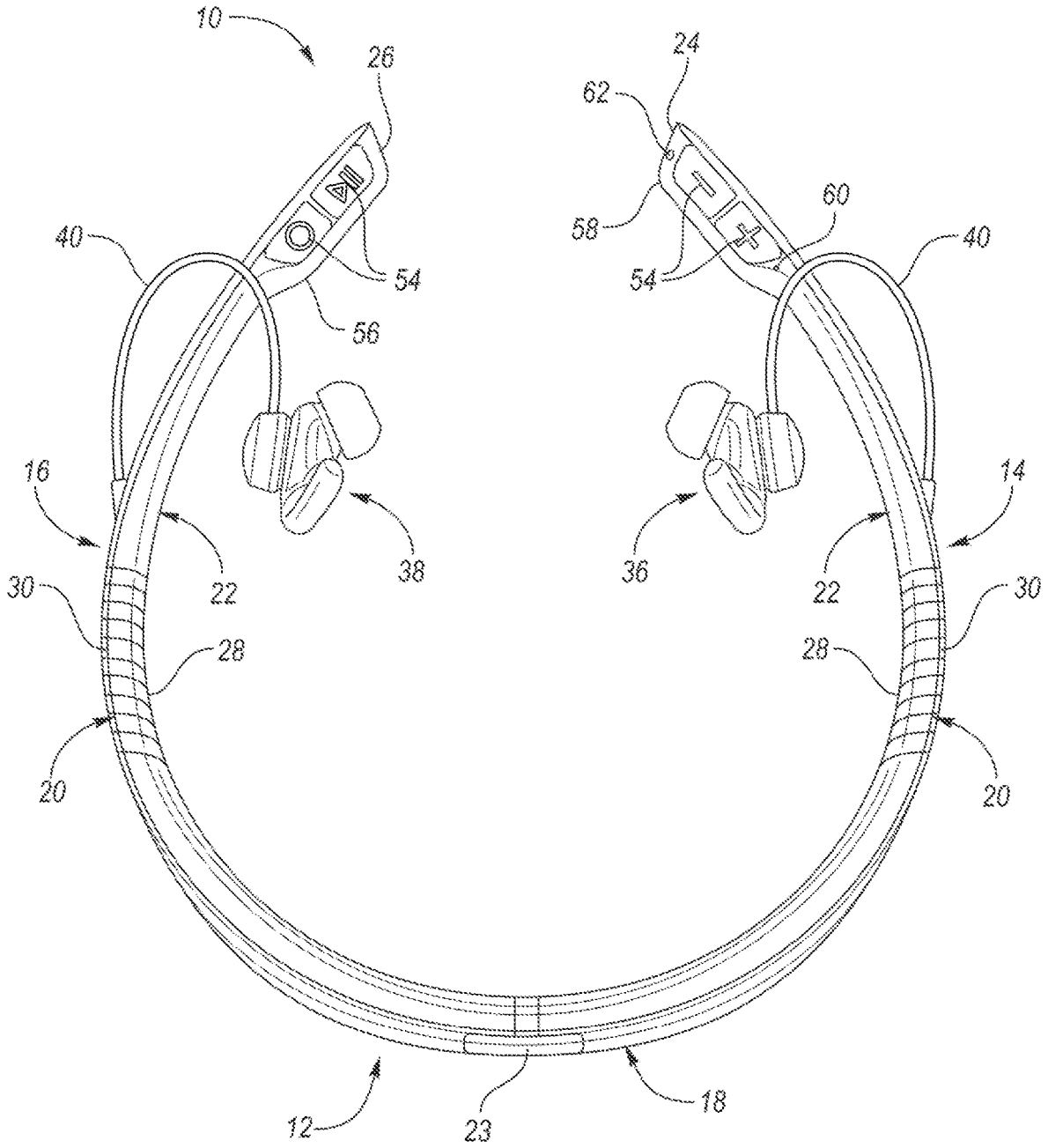
FIG. 2 is a top view of the headphone apparatus.
Figure 3:
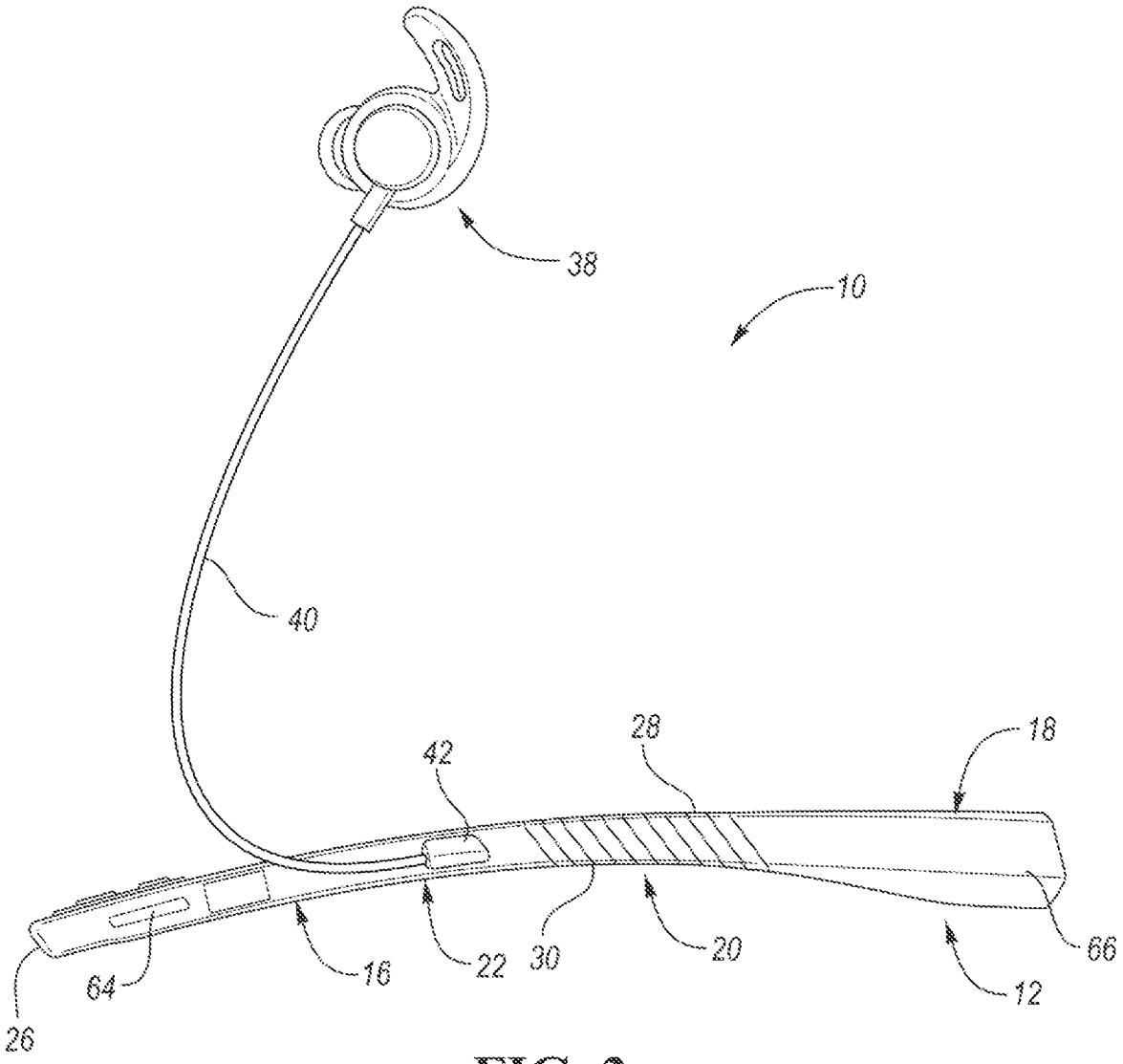
FIG. 3 is a side view of the headphone apparatus.

As best shown in FIGS. 1 and 2, the first and second arms 14, 16 include control buttons 54. Each rigid section 22 may have an enlarged end portion 56 with a cross-sectional area greater than a cross-sectional area of the flexible sections 20, and each enlarged end portion 56 may have a substantially flat surface 58 where the control buttons 54 are positioned. Control buttons 54 may include, but are not limited to, volume control buttons for increasing (+) and decreasing (−) audio volume and audio tracks, a button for audio playback (play/pause) control, and a multifunction button. The multifunction button may be used, for example, for muting and unmuting a microphone 62 during phone calls, activating voice personal assistants, such as Apple Siri or Alphabet Google Now, or enabling and disabling a light element 6 (described below). A power indicator 60, such as an LED, may be provided on the neckband 12, such as on one of the first and second arms 14, 16 for indicating power on/off status. The microphone 62 may be positioned near an end 24 of one of the arms 14, 16 in electrical communication with the control electronics 44. A wireless signal (e.g., Bluetooth) indicator 64 may also be provided on the neckband 12, such as on one of the rigid sections 22. In one embodiment, the headphone apparatus 10 may be configured to enter pairing mode by depressing the two volume buttons simultaneously or by pressing and holding the play/pause button.

Figure 5:
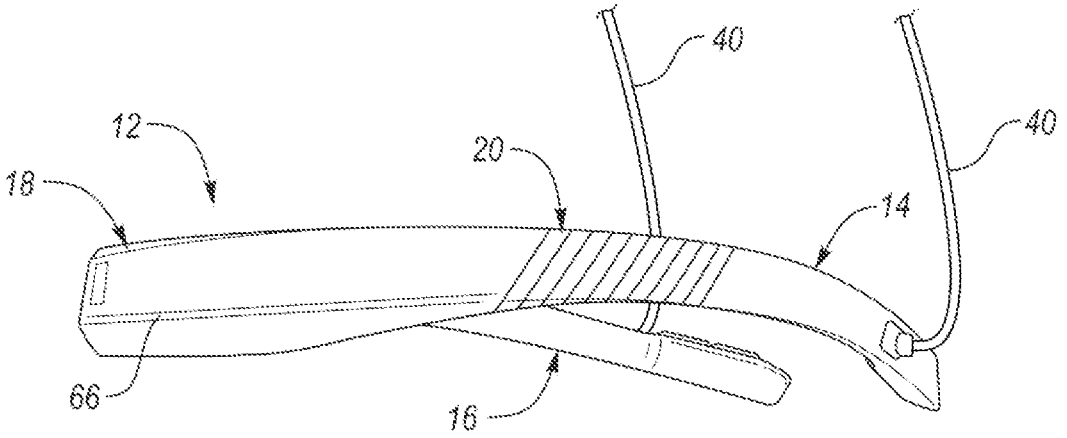
FIG. 5 is a side view of the neckband of the headphone apparatus including a light element according to an embodiment.

With reference to FIG. 5, the neckband 12 may include an elongated light element 66, such as a fiber optic light guide with one or more LEDs, in electrical communication with the control electronics 44. In one embodiment, the light element 66 may be disposed along an exterior of the central portion 18. The light element 66 may be useful as a safety light for illuminating the neckband 12, and thus drawing attention to the user, in the absence of sufficient ambient light. Such a feature may be desirable for users who are outside after dark, perhaps running or walking. The light element 66 may be activated by a user, such as by depression of a control button 54. Alternatively, an ambient light sensor could be provided as part of the control electronics 44, wherein insufficient light received by this sensor could activate the light element 66. It is contemplated that the light element 66 could be configured to illuminate as a solid light or could have different, possibly selectable, flashing patterns.

Turning now to FIGS. 9-12, an embodiment of the earbuds 14, 16 is illustrated, with only the first earbud 14 shown as an example. Each earbud 14 includes a housing 68, which may be constructed from a plastic material, having a speaker 70 disposed therein. The housing 68 may include a generally cylindrical outer portion 72 and an inner portion 74 arranged along an axis 76, wherein at least the inner portion 74 is sized to be received in a user's concha. The electrical conductors 48 and cables 40 include audio signal lines to transmit audio signals from the control electronics 44 to the speaker within each earbud housing 68. In one embodiment, the housing 68 of the earbud 14 may contain a magnet (not shown) of one polarity and the housing 68 of the other earbud 16 may contain a magnet of the opposite polarity, such that the earbuds 14, 16 attract one another and stay connected while not in use for easy storage. It is understood that the earbuds 14, 16 are not limited to association with neckband 12, and can also be configured for use independently or with other headphone arrangements.

Each earbud 14 includes a flexible ear tip 78, such as constructed from a rubber material, removably connected to the housing 68. The ear tip 78 extends from the inner housing portion 74 in a direction offset from the axis 76, where the ear tip 78 sized to be at least partially received in the user's ear canal. In one non-limiting example, the insertion depth of the ear tip 78 into the ear canal may be between about 5 mm-10 mm. The ear tip 78 has a bottom end 80 proximal to the housing 68, a top end 82 distal from the housing 68, and a middle portion 84 therebetween. The top end 82 has an aperture 85 to allow sound from the speaker 70 to be transmitted to a user's ear. In one embodiment, the bottom end 80 has a radius smaller than a radius of the middle portion 84. The smaller radius of the bottom end 80 may increase the comfort of the ear tip 78 and eliminate possible pressure points which are unnecessary to retain the earbud 14 within a user's ear. In another embodiment, the bottom end 80 can have a radius substantially equal to the radius of the middle portion 84. The ear tip 78 is removable from the earbud housing 68, and ear tips 78 of different shapes and sizes can be provided.

The earbud 14 may further include an arcuate extension member 86 extending from the housing 68 and sized to be received in the user's antihelix. As shown, the extension member 86 may be generally planar and extend from the inner portion 74 along a plane of the inner portion 74, and may be constructed from a plastic or rubber material. The extension member 86 has a solid base portion 88 adjacent the inner portion 74 and may include a longitudinal slot 90 extending from an end of the base portion 88 through the extension member 86 and terminating prior to a solid tip portion 92. As shown, the longitudinal slot 88 may be configured to have a generally constant width along a length thereof, and may provide a distinctive visual aesthetic. The earbud 14 may include the extension member 86 integrally formed therewith, which may provide additional stability to the earbuds 14, 16, especially during sport activities. Alternatively, the housing 68 may not include an extension member 86, or the extension member 86 could be provided as a modular component which may be connected to the housing 68.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A wireless headphone apparatus, comprising:

a U-shaped neckband having a first arm and a second arm connected by a central portion, the first and second arms each having an elongated flexible section proximal to the central portion, each elongated flexible section including a memory wire material capable of bending and maintaining a desired shape of the neckband, wherein each flexible section includes a cover having grooves therein to facilitate movement of the flexible section to the desired shape; and first and second earbuds in electrical communication with the neckband.

2. The headphone apparatus of claim 1, wherein the first and second earbuds are connected to the neckband via cables.

3. The headphone apparatus of claim 1, wherein the earbuds each include a housing having a speaker disposed therein and a flexible ear tip removably connected to the housing.

4. The headphone apparatus of claim 1, wherein each earbud includes an arcuate extension member extending from the housing.

5. A wireless headphone apparatus, comprising:

a U-shaped neckband having a first arm and a second arm connected by a central portion, the first and second arms each having an elongated flexible section proximal to the central portion, each elongated flexible section including a memory wire material capable of bending and maintaining a desired shape of the neckband, wherein the memory wire material has a rectangular cross-section such that the memory wire material is more flexible in a plane of the neckband and less flexible in a plane perpendicular to the plane of the neckband; and first and second earbuds in electrical communication with the neckband.

6. The headphone apparatus of claim 5, wherein the first and second earbuds are connected to the neckband via cables.

7. The headphone apparatus of claim 5, wherein the earbuds each include a housing having a speaker disposed therein and a flexible ear tip removably connected to the housing.

8. The headphone apparatus of claim 5, wherein each earbud includes an arcuate extension member extending from the housing.

* * * * *